United States Patent [19]

Williams

[11] 4,411,034

[45] Oct. 25, 1983

[54] BLANKET DEVICE WITH ALARM

[76] Inventor: Althea M. W. Williams, 2097 W. 30th St., Los Angeles, Calif. 90018

[21] Appl. No.: 263,265

[22] Filed: May 13, 1981

[51] Int. Cl.[3] ..... A47G 9/02

[52] U.S. Cl. ..... 5/494; 5/498; 340/568

[58] Field of Search ..... 5/494, 498, 496, 482; 340/568

[56] References Cited

U.S. PATENT DOCUMENTS

| | | | |
|---|---|---|---|
| 2,677,834 | 5/1954 | Moynihan | 5/494 |
| 2,908,899 | 10/1959 | Crafts | 340/568 |
| 3,083,378 | 4/1963 | Pursell | 5/498 |
| 4,253,084 | 2/1981 | Topputo | 340/568 |
| 4,274,077 | 6/1981 | Feiger | 340/568 |

*Primary Examiner*—Alexander Grosz

*Attorney, Agent, or Firm*—Julius Louis Rubinstein

[57] ABSTRACT

A blanket is held in position on a bed by means of adjustable electrically conductive snaps connected between the blanket and the sheet or mattress cover. The snaps are connected to an electrical circuit in such a way that an alarm sounds when the snaps are disconnected.

9 Claims, 7 Drawing Figures

FIG. 1
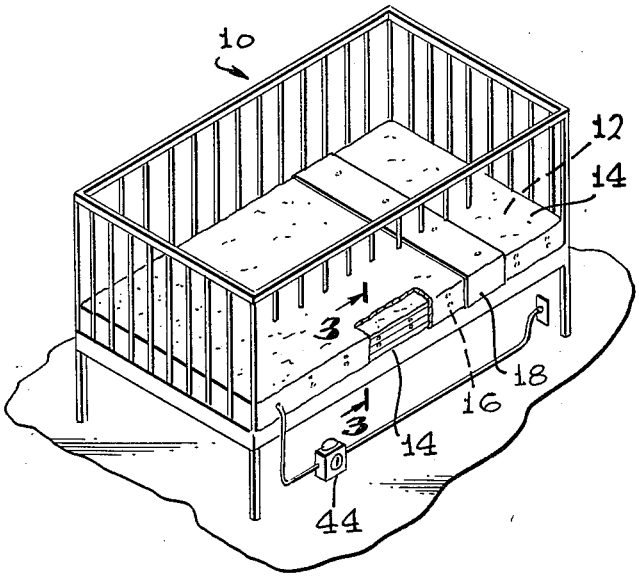
FIG. 2
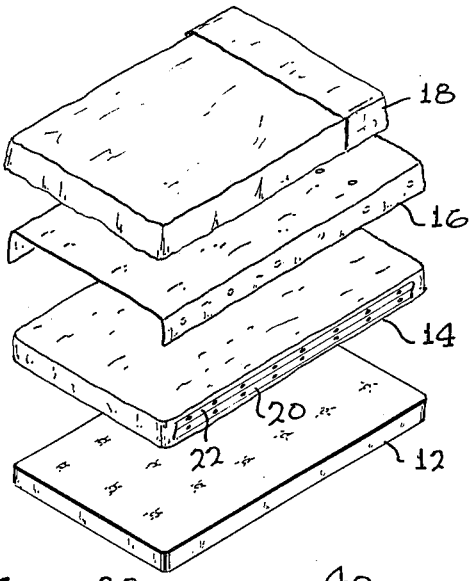
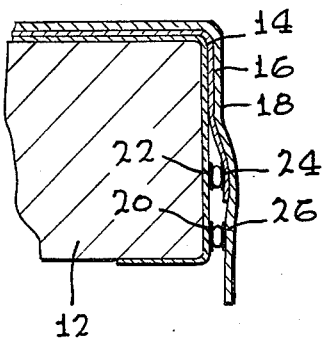
FIG. 3
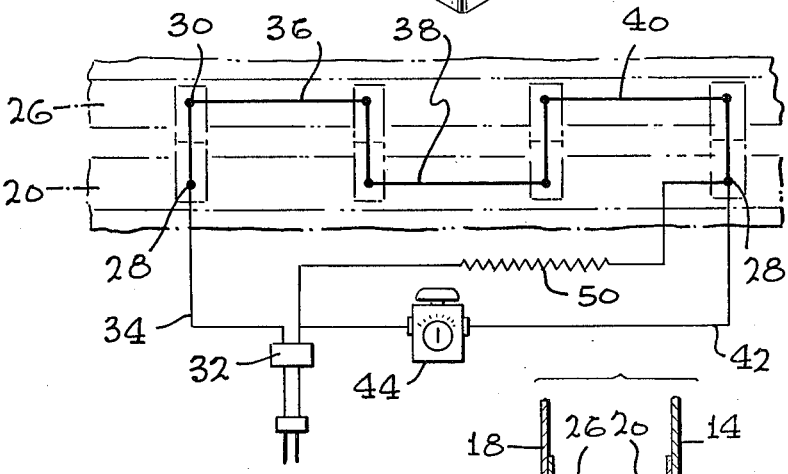
FIG. 7
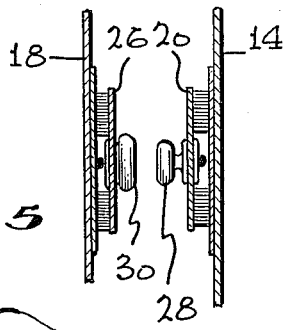
FIG. 5
FIG. 6
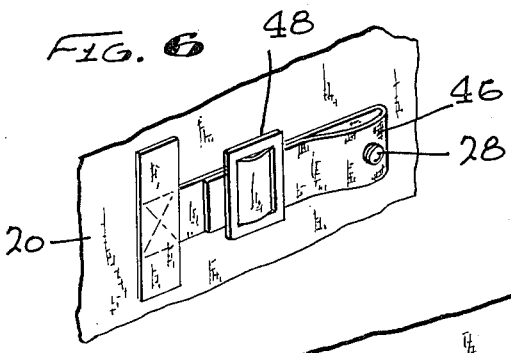
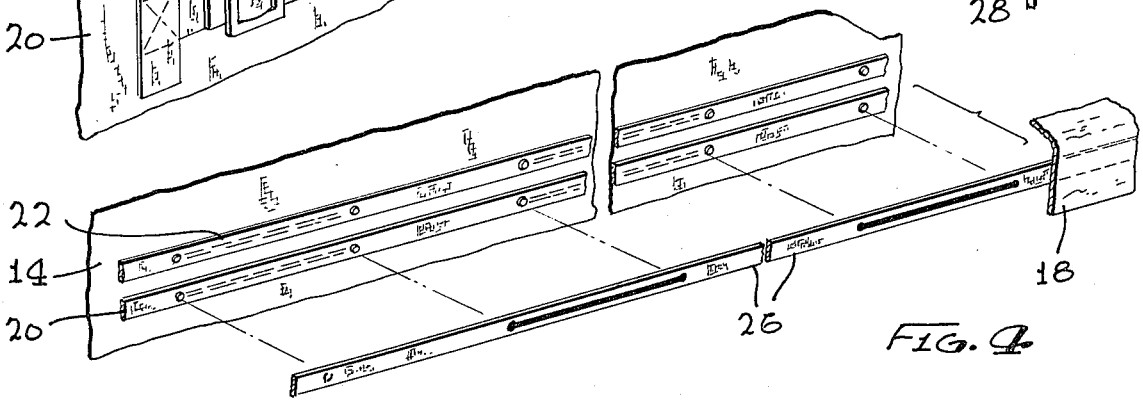
FIG. 4

BLANKET DEVICE WITH ALARM

This invention relates to a bedding retaining means, and more particularly to a device for holding bedding in position on a bed and for sounding a warning when the bedding is disturbed.

STATEMENT OF PROBLEM

The increasing cost of fuel may require home temperatures to be dropped to an uncomfortably low level at night. This could create health problems for children who parents are hard of hearing or who are in a room too distant to hear them cry, either because they are cold because their blankets have fallen off, or because they have fallen out of bed. This suggests that an alarm for indicating when blankets or bedding are disarranged would be useful. Such a device could also be used to provide an alarm in the event the bedding is disturbed by a criminal intruder entering a bedroom and trying to attack or remove a person from the bed.

Such an alarm would be particularly useful in maternity wards in hospitals where, on occasion, emotionally distraught persons have been known to steal infants. In such a ward, babies are usually kept together in cribs in a common room. An alarm system attached to a blanket, sheet, or to the infant's dressing gown in each crib would provide a warning if some unauthorized person attempted to remove the infant.

In addition, it would be desirable to provide a way to the hold the blankets and sheets in position in a crib to prevent an infant from causing the blankets to bunch up over its head with possibly fatal consequences.

All these problems could be solved if an alarm system were attached to the bedding to indicate that a child has kicked his covers off, or fallen out of bed, or that an intruder, in trying to molest a person in a bed, has disturbed the bedding.

However, attachment of an alarm system to bedding creates difficulties because people thrash around a good deal when they sleep and an alarm system that responds to every minor disturbance of the bedding would be impractical.

For this reason it would be desireable to have an alarm system connected to bedding which permits the bedding to be disturbed a controlled amount without triggering the alarm.

Furthermore, the lower night-time room temperatures now prevalent has caused an increase in the use of electric blankets. This creates a danger because the user of the electric blanket could kick it into a ball-like bundle on the bed with the power left on when he gets out of bed. Under these circumstances enough heat could be trapped in the blanket to cause a fire. For this reason it would be desireable to provide the electric blanket with means for automatically cutting off its power when the person, in getting out of bed, disturbs the blanket.

What is needed, therefore, comprises an important object of this invention is a bedding alarm system which triggers an alarm when the bedding is disturbed.

A further object of this invention is to provide a bedding alarm system with an adjustable thrashing movement compensating means which will prevent the alarm system from being triggered unless the bedding is disturbed in excess of a predetermined amount.

Yet another object of this invention is to provide an electric blanket with means for cutting off power to the blanket when the electric blanket is disturbed more than the predetermined amount.

Still, a further object of this invention is to provide a way to hold the blankets and sheets in position in a crib to prevent them from bunching up over an infant's head.

These and other objects of this invention will become more apparent when better understood in the light of the accompanying drawings and specifications wherein:

FIG. 1 is a perspective view of a crib with bedding thereon and provided with an alarm system.

FIG. 2 is an exploded perspective view of the bedding used with the alarm system.

FIG. 3 is a side-sectional view taken on line 3—3 of FIG. 1 showing a portion of the bedding and alarm system.

FIG. 4 is a perspective view of the support strips on which the snaps are mounted.

FIG. 5 is a side-elevational view of a part of a mattress cover and blanket showing details of the way they are held together by electrically conductive snaps.

FIG. 6 is a perspective view of the thrashing movement compensating means to which the conductive snaps are attached.

FIG. 7 discloses the electric circuit of the alarm system.

Referring now to FIG. 1 of the drawing, a crib indicated generally by the reference numeral 10 contains a mattress (12), a mattress cover (14), a sheet (16), and a blanket (18), see FIG. 2.

In this embodiment elongated support strips (20), (22), (24) and (26), formed from an electrically non-conductive cloth-like material are secured by any suitable means to the lower sides of the mattress cover (14), the sheet (16), and the blanket (18), see FIG. 3. In particular, strips (20) and (22) are secured to both sides of the mattress cover (14) while strips (24) are secured to both sides of the sheets (16) and the strips (26) are secured to both sides of the blanket (18), see FIGS. 3 and 4. The strips (20) and (22) are adjacent to and parallel to the opposed long sides of the mattress cover and are in spaced parallel relationship to each other. Strips (24) are disposed adjacent to and parallel to the long sides of the sheet (16) while the strips (26) are disposed adjacent to and parallel to the long sides of the blanket (18). It is understood that the term "blanket" means any covering for a person on a bed, including another sheet as where the room and temperature is too high for a usual blanket.

A plurality of male snaps (28) formed from an electrically conductive material are mounted on the strips (20) and (22) preferably in uniformly spaced relationship to each other along the strips, see FIGS. 4 and 5. A plurality of female snaps (30) also formed from electrically conductive material are mounted on strips (24) and (26) in spaced relationship to each other opposite male snaps (28).

In assembled relation, the mattress cover (14) is put on the mattress (12). The support strips (20) and (22) are removably secured to the lower sides of the mattress cover by the use of hook and loop type fasteners, zippers, or other suitable means. Then the sheet (16) with strips (24) removably secured to its lower sides and carrying female snaps (30) is laid over the mattress cover and the male and female snaps on strips (22) and (24) are pressed together to hold the sheet securely on the mattress cover (14).

Then blanket (18) with strips (26) carrying the female snaps (30) is laid over sheet (16) and the male and female snaps (28) and (30) on strips (20) and (26) are pressed together to hold the blanket (18) securely to the mattress covers and neatly on the bed over the sheet (16), see FIG. 3.

When used in cribs, the male and female snaps (28) and (30) function to hold the blanket and sheets in position on the bed despite the movement infants make in their sleep. This prevents the blankets from bunching up over their head, possibly causing suffocation.

In addition an alarm system is provided, preferably powered by ordinary house electricity. The house voltage is fed through transformer (32) to reduce its level so it can be safely connected to the bedding, see FIG. 7. One power line (34) from transformer (32) is electrically connected to snaps (28) on strips (20), see FIG. 7. Snaps (28) on strips (20) are connected to a corresponding snaps (30) on strips (26).

As shown in FIG. 7, adjacent snaps (30) on strip (26) and snaps (28) on strip (20) are divided into pairs. Electrical wires (36, (38) and (40) are connected between the adjacent snaps of each pair. The wires connecting adjacent snaps (30) on strip (26) are offset from the wires connecting adjacent snaps (28) on strip (20) in such a way that when the snaps are connected together, all the mating snaps provide a conductive wire leading to the alarm (44), see FIG. 7. The alarm (44) may be provided with holding relays, or the like, in a manner well known in the art, and functions to sound an alarm when power is cut off as by separation of any of the mating snaps (28) and (30) on strips (20) and (26). With this arrangement, when the corresponding snaps are all connected together, power flows through the alarm system and the completed circuit prevents an alarm from sounding. However, if one of the snaps becomes disconnected, the circuit is broken causing the alarm to sound.

The alarm system described so far uses the conductive snaps on strips (20) and (26) on the mattress cover and blanket. The snaps on strips (22) and (24) on the mattress cover and sheet serve to hold the sheet neatly and securely on the mattress cover.

It is, of course, understood that the alarm system described could be connected to the snaps on strips (22) and (24) of the sheet and mattress cover, instead of using the conductive snaps on the blanket and the mattress cover. Alternatively, the snaps on the strips (22) and (24) could be electrically connected to the snaps on strips (20) and (26) in the manner shown on FIG. 7 and in such a way that if any of the mating snaps on the blanket or sheet are separated from any of the snaps on the mattress cover, the alarm sounds. If the alarm system is used in maternity wards, conductive snaps could be attached to the infant's gown and the sheet so that if these snaps are separated the alarm would be triggered.

The circuit described so far will work, but it may not be practical. This is because people thrash around a good deal while asleep and they could easily cause the snaps to disconnect even if the blanket is still covering the person. If this happened too often the alarm system would soon be ignored and the system would not be used.

To provide an adjustable means for compensating for the thrashing movement people make when they are asleep, snaps (28) instead of being secured directly to strips (20) and (22) could be mounted on one end of elastic strips (46). The opposite end of each of the elastic strips would be secured to strips (20) and (22), see FIG. 6. With this arrangement, when a child or person in the bed kicks or turns in bed, the elastic strips (46) holding the snaps (28) will stretch and contract enough to prevent the snaps (28) and (30) from separating and causing the alarm to sound, so long as the stretch of the elastic strips (46) is below a predetermined limit. This arrangement, which accommodates normal movements a person makes while asleep, prevents the alarm from sounding unless body movements are great enough to cause the snaps to separate. Since people differ in their thrashing movements, an adjustment is provided for compensating for the behaviors of various people. This adjustment is in the form of a belt buckle (48) to which the different elastic strips (46) are attached. With this arrangement the length of the elastic strips can be varied to accommodate the needs of different persons in order to prevent the alarm from sounding unnecessarily.

If it is desired to automatically cut-off power to an electric blanket (50) when the blanket is disturbed in the morning as when a person gets out of bed, the conductive snap (28) shown in FIG. 4 could be electrically connected to the input of the electric blanket (50), see FIG. 7. With this arrangement, power to the blanket would be cut-off automatically when a person gets out of bed because this would cause some of the snaps (28) and (30) to separate.

Having described the invention what I claim as new is:

1. An apparatus of the class described comprising a mattress and a blanket, a first group of electrically conductive snaps mounted on the blanket, a second group of electrically conductive snaps mounted in generally fixed relationship to said mattress, said first group of snaps adapted to mate with said second group of snaps, an alarm system connected to said snaps in such a way that an alarm sounds when any of the mating snaps separate, and a thrashing movement adjustment means connected to said snaps to prevent said snaps from separating until said blanket is moved a predetermined distance from its position on the bed.

2. An apparatus of the class described comprising a mattress and a blanket, a first strip formed from nonconductive fabric removably secured to a side of said blanket, a first group of snaps formed from electrically conductive material mounted in spaced relationship to each other along the length of said first strip, a second strip of non-conductive fabric adapted to be removably mounted over a side of said mattress in generally fixed relationship thereto, a second group of electrically conductive snaps mounted in spaced relationship along the length of said second strip, said first group of snaps mating with said second group of snaps to hold said blanket into position on a bed, an electrical alarm system connected to said snaps in such a way that an alarm is triggered whenever any of the mating snaps separate, and a thrashing movement compensating means to prevent said snaps from separating until said blanket is moved a predetermined distance from is position on said bed.

3. The apparatus described in claim 2 wherein the snaps in at least one of said groups is mounted on a portion of a piece of elastic material, another portion of said elastic material secured to one of said strips, whereby when a person covered by the blanket thrashes about in his sleep the elastic material can stretch a predetermined amount to accommodate his thrashing movements before the snaps separate triggering the alarm.

4. The apparatus described in claim 3 including means for varying the length of the elastic material in order to vary the predetermined amount of stretch the elastic material can have before the conductive snaps separate whereby the distance the blanket can be shifted on the bed before the conductive snaps separate and the alarm is triggered can be varied.

5. The apparatus described in claim 4 wherein said means for varying the unstretched length of said elastic material includes a belt buckle to which the elastic material is attached.

6. The apparatus described in claim 2 wherein adjacent snaps in said first group of snaps are divided into pairs, an electrical conductor connected between the adjacent snaps of each pair, adjacent snaps in said second group of snaps divided into pairs, an electrical conductor connected between the adjacent snaps of each pair in the second group, the electrical conductor connected between the pairs of snaps on said first group offset from the electrical conductor connected between the pairs of snaps from the second group in such a way that when the snaps are connected together, all the mating snaps and electrical conductors form a conductive wire extending along the length of the blanket; said conductive wire connected to the alarm system in such a way that alarm is triggered whenever the snaps separate.

7. The apparatus described in claim 6 wherein the snaps in at least one of said groups is mounted on a portion of a piece of elastic material, another portion of said elastic material secured to one of said strips, whereby when a person covered by the blanket thrashes about in his sleep, the elastic material can stretch a predetermined amount to accommodate his thrashing movements before the snaps separate, thereby triggering the alarm.

8. The apparatus described in claim 7 including means for varying the length of the said elastic material in order to vary the predetermined amount of stretch the elastic material can have before the conductive snaps separate, whereby the distance the blanket can be shifted on the bed before the conductive snaps separate and the alarm is triggered can be varied.

9. The apparatus described in claim 8 wherein said means for varying the unstretched length of said elastic material includes a belt buckle to which the elastic material is attached.

* * * * *